US011125125B2

(12) United States Patent
Cecrle et al.

(10) Patent No.: US 11,125,125 B2
(45) Date of Patent: Sep. 21, 2021

(54) LEAF SPRING SLIDING CONTACT FOR ELECTRICALLY ACTUATED ROCKER ARM ASSEMBLY

(71) Applicant: Eaton Intelligent Power Limited, Dublin (IE)

(72) Inventors: Jiri Cecrle, Prague (CZ); Dale Arden Stretch, Novi, MI (US); Michael J. Campbell, Scotts, MI (US)

(73) Assignee: Eaton Intelligent Power Limited, Dublin (IE)

( * ) Notice: Subject to any disclaimer, the term of this patent is extended or adjusted under 35 U.S.C. 154(b) by 93 days.

(21) Appl. No.: 16/677,730

(22) Filed: Nov. 8, 2019

(65) Prior Publication Data

US 2020/0095908 A1 Mar. 26, 2020

Related U.S. Application Data

(63) Continuation-in-part of application No. PCT/US2018/031697, filed on May 8, 2018.
(Continued)

(51) Int. Cl.

| | |
|---|---|
| ***F01L 13/00*** | (2006.01) |
| ***H01R 35/04*** | (2006.01) |
| ***H01R 25/16*** | (2006.01) |
| ***F01L 1/18*** | (2006.01) |
| ***F01L 1/053*** | (2006.01) |

(52) U.S. Cl.
CPC ..... *F01L 13/0021* (2013.01); *F01L 1/053* (2013.01); *F01L 1/185* (2013.01); *F01L 13/0005* (2013.01); *H01R 25/168* (2013.01); *H01R 35/04* (2013.01); *F01L 2201/00* (2013.01); *F01L 2303/00* (2020.05)

(58) Field of Classification Search
CPC ... F01L 1/053; F01L 1/185; F01L 1/18; F01L 2001/186; F01L 2201/00; F01L 13/0021; F01L 13/0005; H01R 25/168; H01R 35/04
USPC ..... 123/90.16
See application file for complete search history.

(56) References Cited

U.S. PATENT DOCUMENTS 5,544,626 A * 8/1996 Diggs ..... F01L 13/0005 123/90.16
10,358,951 B2 7/2019 Liskar et al.
(Continued)

FOREIGN PATENT DOCUMENTS

EP 0833041 B1 2/2002
WO WO-2016028812 A1 * 2/2016 ..... F01L 1/185
WO WO-2018075392 A1 * 4/2018 ..... F01L 1/18

*Primary Examiner* — Devon C Kramer
*Assistant Examiner* — Kelsey L Stanek
(74) *Attorney, Agent, or Firm* — Paul V. Keller

(57) ABSTRACT

A valvetrain includes a rocker arm assembly and a power transfer module that provides power to the rocker arm assembly. The power transfer module includes a mounting frame that positions a resilient contact to abut and slide over a corresponding contact on the rocker arm assembly thereby maintain an electrical connection to the rocker arm assembly during rocker arm assembly operation. In some embodiments the structure facilitates retention of the rocker arm assembly on a pivot. The contact on the rocker arm may be provided by a contact pin. The mounting frame may abut and/or go around a pivot for the rocker arm assembly. A contact frame on the rocker arm may hold conductors of the electrical circuit extending from the contacts.

20 Claims, 11 Drawing Sheets

Related U.S. Application Data

(60) Provisional application No. 62/503,303, filed on May 8, 2017, provisional application No. 62/849,447, filed on May 17, 2019.

(56) References Cited

U.S. PATENT DOCUMENTS

| | | | | |
|---|---|---|---|---|
| 2003/0111031 | A1* | 6/2003 | Hendricksma | F01L 1/18<br>123/90.15 |
| 2015/0167772 | A1* | 6/2015 | Street | B61F 5/10<br>267/64.27 |
| 2018/0142583 | A1* | 5/2018 | Liskar | F01L 1/2405 |
| 2018/0195419 | A1* | 7/2018 | Liskar | H01F 7/02 |
| 2019/0257227 | A1* | 8/2019 | Mccarthy, Jr. | F01L 13/0005 |

* cited by examiner

LEAF SPRING SLIDING CONTACT FOR ELECTRICALLY ACTUATED ROCKER ARM ASSEMBLY

FIELD

The present teachings relate to valvetrains, particularly valvetrains providing variable valve lift (VVL) or cylinder deactivation (CDA).

BACKGROUND

Hydraulically actuated latches are used on some rocker arm assemblies to implement variable valve lift (VVL) or cylinder deactivation (CDA). For example, some switching roller finger followers (SRFF) use hydraulically actuated latches. In these systems, pressurized oil from an oil pump may be used for latch actuation. The flow of pressurized oil may be regulated by an oil control valve (OCV) under the supervision of an engine control unit (ECU). A separate feed from the same source provides oil for hydraulic lash adjustment. In these systems, each rocker arm assembly has two hydraulic feeds, which entails a degree of complexity and equipment cost.

The oil demands of these hydraulic feeds may approach the limits of existing supply systems. The complexity and demands for oil in some valvetrain systems can be reduced by replacing hydraulically latched rocker arm assemblies with electrically latched rocker arm assemblies. Electrically latched rocker arm assemblies require power. There is an ongoing need for reliable structures for power transfer to the rocker arm assembly.

SUMMARY

The present teachings provide a valvetrain suitable for an internal combustion engine that includes a combustion chamber, a movable valve having a seat formed within the combustion chamber, and a camshaft. The valvetrain includes a camshaft and a rocker arm assembly. The rocker arm assembly includes a rocker arm, a cam follower configured to engage a cam mounted on the camshaft as the camshaft rotates, and an electrical device mounted to the rocker arm. The rocker arm assembly may rest on a pivot that is supported by a cylinder head of the engine. The electrical device may be an electromagnet of an electromagnetic latch assembly. The present teachings relate to powering the electrical device. If the electrical device were powered with conventional wiring, it would be possible for a wire would be caught, clipped, or fatigued and consequently short out.

According to some aspects of the present teachings, an electrical circuit that powers the electrical device includes a connection formed by abutment between a first part and a second part, which are two distinct parts. The rocker arm assembly is operative to move the second part relative to the first part in response to actuation of the rocker arm assembly through the cam follower. The relative movement causes the second part to slide over a surface of the first part. The first part is a contact pad having resiliency that biases the contact pad against the second part. Structuring the second part as a resilient contact pad allows for a compact structure in which the electrical connection may be maintained even as the rocker arm assembly undergoes a wide range of motion relative to the second part. A contact pad mounted to a part distinct from the rocker arm assembly may be larger than a contact pad mounted on the rocker arm. In some of these teachings, the contact pad is a leaf spring.

In some of these teachings, the contact pad is held by a mounting frame that rests against the cylinder head of the engine. In some of these teachings the mounting frame abuts a pivot that provides a fulcrum for the rocker arm assembly. In some of these teachings that the mounting frame goes around the pivot. In some of these teaching, the mounting frame abuts two or more pivots that provide fulcrums for rocker arm assemblies of the valvetrain. In some of these teachings, the mounting frame goes around two of the pivots. In some of these teachings, the mounting frame is over-molded about the contact pad. In some of these teachings, the contact pad is coupled to a metal lead. In some of these teachings the mounting frame supports the metal lead. In some of these teachings the mounting frame contains the metal lead. The mounting frames of the present disclosure provide structures that hold the contact pads reliably and with correct positioning while making efficient use of the limited space around the rocker arm assemblies.

In some of these teachings, the second part is held to the rocker arm. In some of these teachings, the second part is a contact pin. In some of these teachings, the second part is held to one side of the rocker arm. In some of these teaching the electrical circuit includes a second electrical connection made by abutment between surfaces of two distinct parts, the second connection being made between a second resilient contact pad and second a contact pin held to the opposite side of the rocker arm from the first resilient contact pad and the first contact pin.

According to some aspects of the present teachings, the contact pads bend toward the rocker arm assembly in an area above the contact pins. The inward bends are operative together with the contact pins to improve retention of the rocker arm assembly on a pivot. The inward bends may be provided by protrusions in the contact pads. The contact pads may be sheet metal. The protrusions may be bulges on the contact pad surfaces, such as bulges formed by inward facing rolls in sheet metal. In some of these teaching, the protrusions or inward bends are formed by rolls in the contact pads that form inward-facing lips.

In some of these teachings, the valvetrain includes a latch assembly mounted on the rocker arm assembly and the latch assembly includes a latch pin and an electromagnet that is powered through two electrical connections according to the present teachings. The electromagnet is operable to move the latch pin between a first latch pin position and a second latch pin position. A power transfer module includes a mounting frame that supports the two contact pads of the two electrical connections. The mounting frame has a base that abuts a pivot that provides a fulcrum for the rocker arm assembly. The contact pads extend upward from the base and terminate at a height that is below a height the which the rocker arm assembly rises above the pivot. In some of these teachings, the contact pads extend upwards 20 mm or less. In some of these teachings, the contact pads are free-floating above the base. The short contact pads that extend upward from the base provide a better package design than longer contact pads or contact pads that are held at the top as well as at the bottom. The design allows a rocker arm assembly to be installed by lowering it onto a pivot after the mounting frame has been placed on the cylinder head. The mounting frame may fit around the pivot and be held in position by the pivot.

In some of these teachings, the contact pads angle outward from the rocker arm assembly as they extend upward from the base. Having the contact pads angle outward minimizing the possibility of the rocker arm assembly rocking to one or the other side to strike one of the contact pads. Consistent with this alternative, the contact pads may bend inward above the contact pins. In a method according to the present teachings, a rocker arm assembly is installed on a pivot by deforming the contact pads outward to get the contact pins past the inward bends.

The rocker arm assembly has a front end and a back end. The front end is the end proximate to which the rocker arm assembly abuts a valve stem. The back end is proximate the location where the rocker arm assembly rests on the pivot. The pivot may have a dome-shaped upper surface and the rocker arm may have a gothic profile formed in its bottom surface to interface with the dome of the pivot. In some of these teachings, the contact pads extend toward the back end as they extend upward from the base. In some of these teachings, the inward bends in the contact pads above the contact pins continue into the backward extended area of the contact pad. This design facilitates retention of the rocker arm assembly on the pivot during a critical shift wherein the rocker arm may jump on the pivot and be displaced toward the back end. A contact pad that extends backward as it rises from the base to provide this backward area for contact pin-retention is more easily packaged as compared to the alternative of providing a contact pad that extends sufficiently far backward from the base on upward.

In some of these teachings the contact pins on the rocker arm are held by a contact frame that extends over the back of the rocker arm and around the sides of the rocker arm to where the contact pins are. In some of these teachings, the contact frame fits partially within an opening formed in the back of the rocker arm. In some of these teachings, conductors of the electrical circuit running from the contact pins at the sides of the rocker arm are enclosed within the contact frame. In some of these teachings, the contact frame snaps around the sides of the rocker arm. In some of these teachings, the contact frame must be deformed to be placed in or removed from its position on the rocker arm. In some of these teachings, a combination of protrusions and indentations on the contact frame and the rocker arm necessitate the deformation. In some of these teachings, the contact pins are piloted into the sides of the rocker arm for stability. The contact frame is a compact structure for holding the electrical connections and their wiring. It is particularly well suited for adapting latching rocker arm assemblies that were designed for hydraulic actuation for use with electrical actuation. Having contact pins on both sides of the rocker arm balances the forces placed by the resilient contact pads on the rocker arm assembly.

In some of these teachings, the rocker arm assembly is configured to pivot approximately on an axis when actuated through the cam follower and the electrical connection is made proximate the axis. In some of these teachings, pivoting induces movements of the rocker arm assembly at the location of the electrical connection that are 10% or less the simultaneous movements of the rocker arm assembly at points on the rocker arm assembly distal from the axis.

In some of these teachings, the abutting surfaces of the first part and the second part are electrically isolated from ground. In some of these teachings, the ground corresponds to a cylinder head of an engine in which the valvetrain is installed. In some of these teachings, the electrical connection couples the electrical device with a power source. In some of these teachings, the electrical device is an electromagnetic latch assembly. In some of these teachings, the electromagnetic latch assembly switches the rocker arm assembly between first and second configurations. In the first configuration, the rocker arm assembly is operative to actuate a movable valve in response to rotation of a camshaft to produce a first valve lift profile. In the second configuration, the rocker arm assembly is operative to actuate the movable valve in response to rotation of the camshaft to produce a second valve lift profile, which is distinct from the first valve lift profile, or the movable valve is deactivated. In some of these teachings, a processor is operatively coupled to communicate with the electrical device through the electrical connection.

In some of these teachings, the valvetrain is operable to move the rocker arm assembly in a way that causes the contact area of the electrical connection to move between first and second portions of the resilient contact pad and the electrical circuit resistance varies according to which of the first and second portions of the contact pad the connection is made through. In some of these teachings, the second portion of the resilient contact pad has a coating that increases the resistance. These structures may be used to provide on board diagnostic feedback.

Some aspects of the present teachings relate to an internal combustion engine in which a valvetrain according to the present teachings is installed. The internal combustion engine includes a cylinder head. In some of these teachings, the electrical connection is electrically isolated from the cylinder head. In some of these teachings, a mounting frame that holds the resilient contact pad rests on the cylinder head. In some of these teachings, the mounting frame rests on the cylinder head adjacent a pivot for the rocker arm assembly. In some of these teachings, the mounting frame also rests on the cylinder head at a point above the rocker arm assembly.

The primary purpose of this summary has been to present certain of the inventors' concepts in a simplified form to facilitate understanding of the more detailed description that follows. This summary is not a comprehensive description of every one of the inventors' concepts or every combination of the inventors' concepts that can be considered "invention". Other concepts of the inventors will be conveyed to one of ordinary skill in the art by the following detailed description together with the drawings. The specifics disclosed herein may be generalized, narrowed, and combined in various ways with the ultimate statement of what the inventors claim as their invention being reserved for the claims that follow.

DETAILED DESCRIPTION

Figure 1:
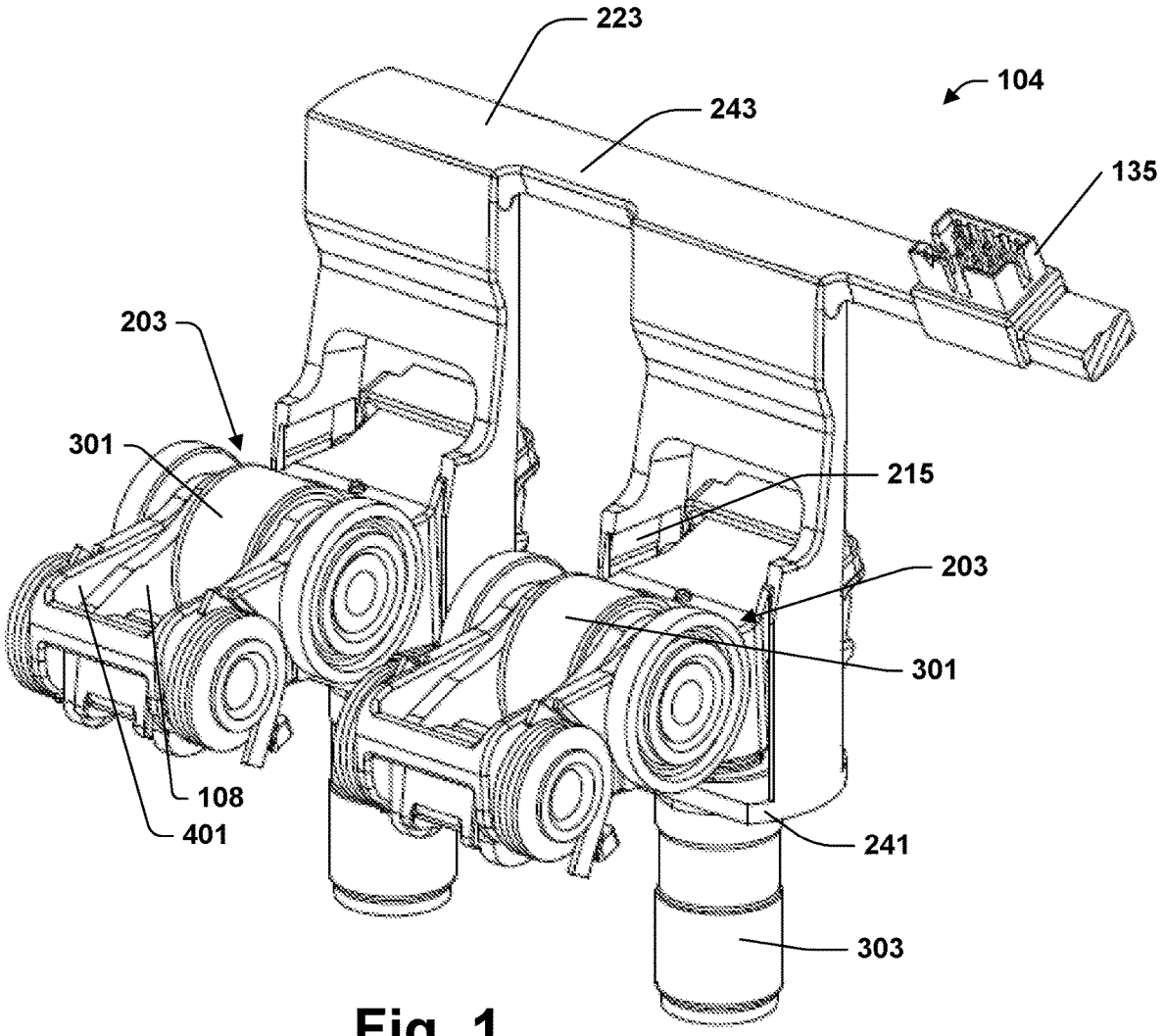
FIG. 1 is a perspective view of a portion of a valvetrain according to some aspects of the present teachings.
Figure 4:
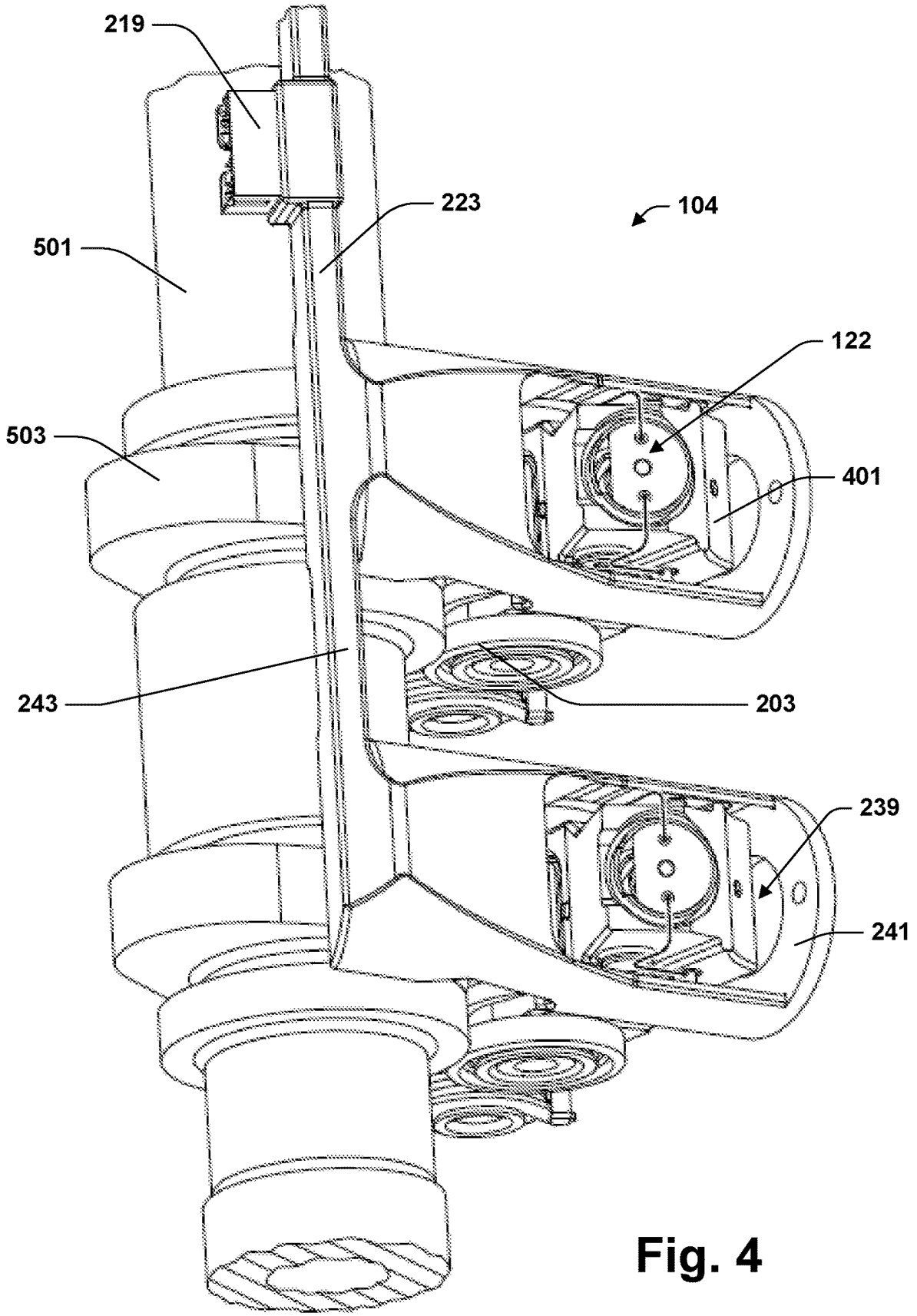
FIG. 4 is another perspective view of the valvetrain of FIG. 1 with exposed wiring.
Figure 5:
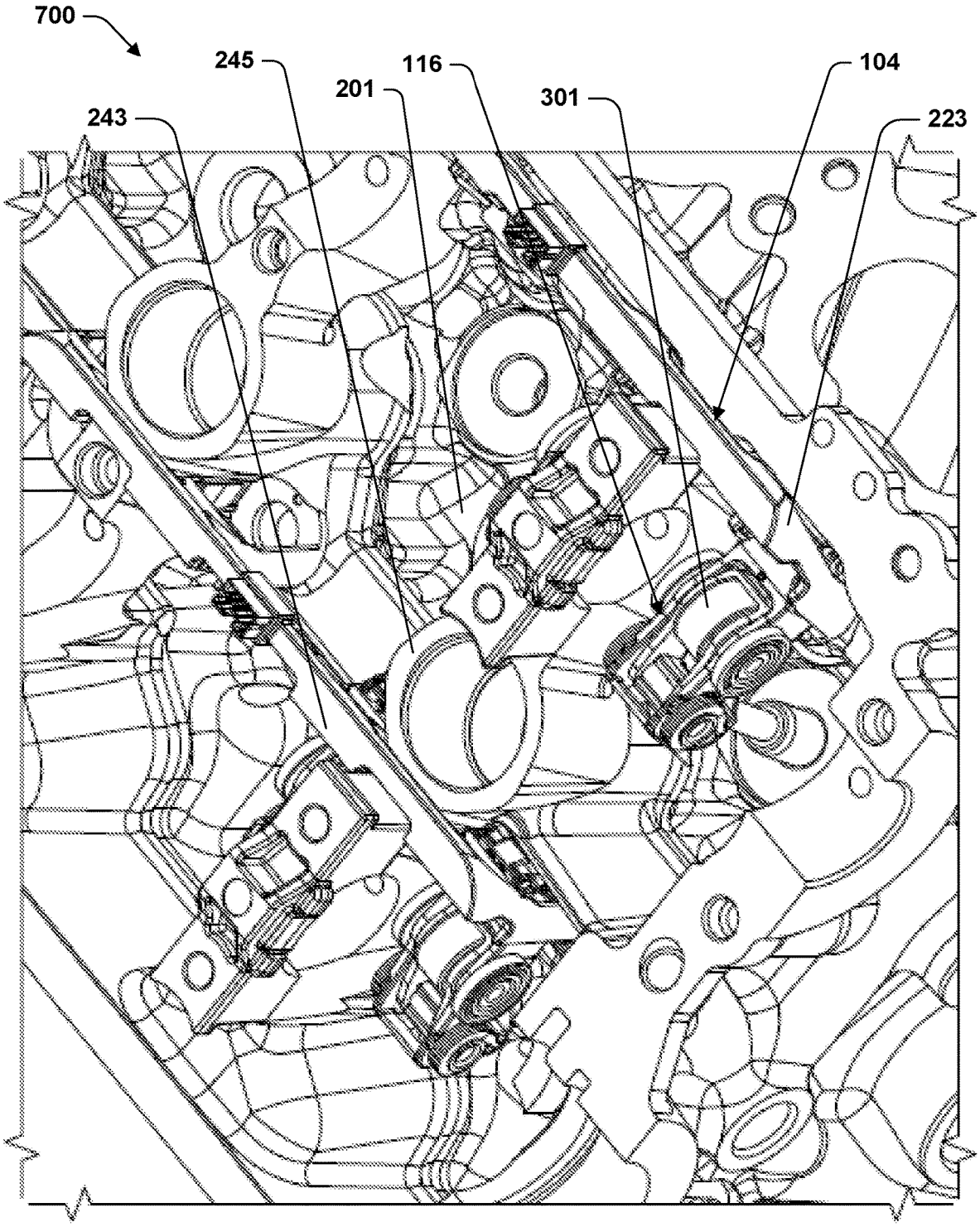
FIG. 5. is perspective view of the valvetrain of FIG. 1 installed in an engine.

FIGS. 1-5 illustrate a valvetrain 104 according to some aspects of the present teachings. FIG. 1 provides a perspective view of a portion of valvetrain 104 that includes two rocker arm assemblies 203, two pivots 303, and a power transfer module 223. A power transfer module, as the term is used in the present disclosure, is a mounting frame that holds an electrical contact in position adjacent a rocker arm assembly. Power transfer module 223 is shown separately in FIG. 2. A rocker arm assembly 203 is shown separately in FIG. 3. FIG. 4 provides another view of valvetrain 104 that includes a camshaft 501 and cams 503, which are configured to actuate rocker arm assemblies 203 through cam followers 301. FIG. 5 provides a top view with parts of valvetrain 104 installed within an engine 700 having a cylinder head 201. As shown in FIG. 1, pivots 303, which may be hydraulic lash adjusters, provide fulcrums for rocker arm assemblies 203.

Rocker arm assemblies 203 each include two pivotally connected rocker arms, rocker arm 401 and rocker arm 108. Rocker arm 401 and rocker arm 108 are selectively engaged by a latch pin (not shown) of an electromagnetic latch assembly 122 that is mounted to rocker arm 401. Electromagnetic latch assembly 122 includes a coil (not shown). Energizing the coil with DC current in a forward direction actuates the latch pin to an engaging position. Energizing the coil with DC current in a reverse direction actuates the latch pin to a non-engaging position. The coil receives power via contact pins 403, which are mounted to and held at the sides of rocker arm 401. Contact pins 403 may be positioned within pilot holes formed in the sides of rocker arm 401. Regardless, insulation may be provided to prevent electrical contact between contact pins 403 and rocker arm 401.

Power transfer module 223 includes leaf springs 215. Leaf springs 215 are electrical conductors. Power transfer module 223 is designed to hold leaf springs 215 in abutment with contact pins 403. Electrical connections through which electromagnetic latch assembly 122 may be powered are made between contact pins 403 and leaf springs 215. Electrical contact may be maintained even as contact pins 403 slide over the surfaces of leaf springs 215 in connection with actuation of rocker arm assemblies 203 by camshaft 501 through cams 503 or in connection with lash adjustment by extension and contraction of pivots 303.

Rocker arm assemblies 203 are configured to undergo a pivoting motion as they are actuated by cams 503. This pivoting occurs approximately on an axis. In some of these teachings, contact pins 403 are located proximate that axis to keep the relative motions between contact pins 403 and leaf springs 215 small. The range of motion cams 503 induce on contact pins 403 may be 10% or less the range of motion cams 503 induce on parts of rocker arm assemblies 203 most distant from the axis. In some of these teachings, the range of motion for contact pins 403 is 2% or less the motion induced on the parts of rocker arm assemblies 203 most distant from the axis.

On the other hand, in some of these teachings, a certain range of motion between contact pins 403 and leaf springs 215 is desirable. A portion of the surface of a leaf spring 215 may be coated with a material that significantly increase the resistance of an electrical circuit comprising a connection between contact pin 403 and leaf spring 215. The material may be, for example, diamond-like carbon. Contact pin 403 may move to that high resistance surface only when cam 503 is lifting rocker arm 401. The increase in resistance may be detected and used to provide rocker arm position information, which in turn may be used in diagnostic or control operations.

Figure 2:
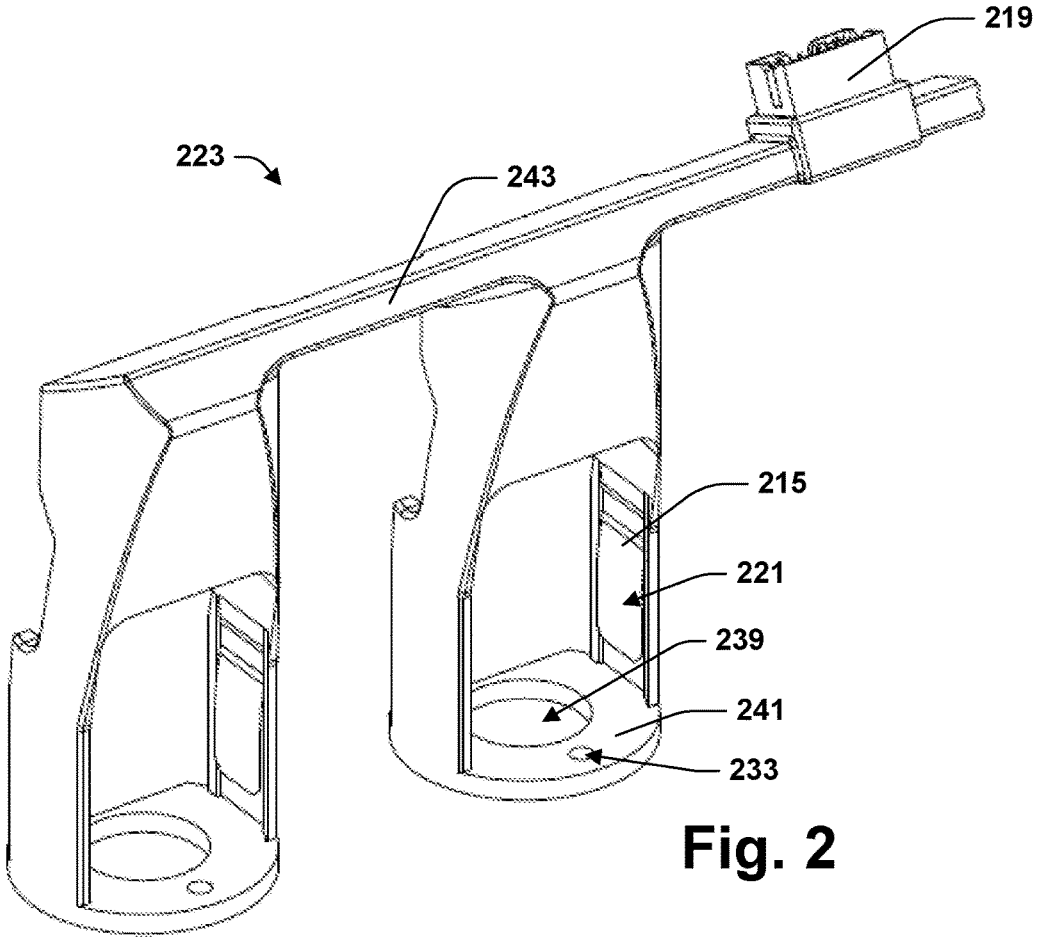
FIG. 2 is a perspective view of a mounting frame that holds resilient contact pads in the valvetrain of FIG. 1.
Figure 3:
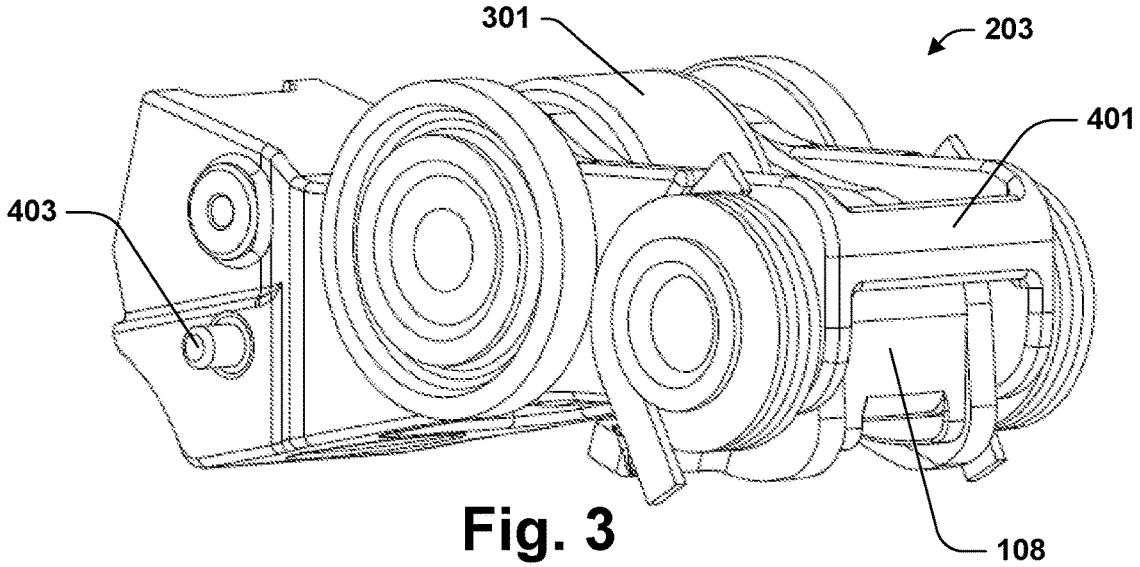
FIG. 3 is a perspective view of one of the rocker arm assemblies in the valvetrain of FIG. 1.

As can be seen in FIG. 2, leaf springs 215 have an outwardly bowed portion 221 adapted to press against contact pin 403. Power transfer module 223 may be adapted to maintain the outward bow of bowed portion 221. These adaptations may include structures that hold leaf spring 215 above and below the bowed portion 221. In some of these teachings, power transfer module 224 is over-molded around leaf spring 215, wherein the over-molding secures leaf spring 215 to power transfer module 224. In some of these teachings a portion of leaf spring 215 is bent and the bent portion abuts power transfer module 224 to keep leaf spring 215 from extending.

Contact plug 219 may be used to couple power transfer module 224 to a vehicle's electrical system. An elevated location, such as a location above the height of rocker arm assembly 203, facilitates the coupling with the vehicle's electrical system in that wires connecting to contacts 219 have a short distance to travel before passing through the valve cover (not shown). The wires may pass through the valve cover adjacent a spark plug tower. One option is to run the wires into and out of a spark plug tower in order that they pass through the valve cover within a spark plug tower.

Power transfer module 224 has a lower portion 241 that rests against cylinder head 201 adjacent pivot 303 and an upper portion 243 that fits over and may rest on a raised portion 245 of cylinder head 201. Raised portion 245 may be above rocker arm assembly 203. "Above" is used in the sense that rocker arm assembly 203 is "above" a combustion chamber contained within cylinder head 201. Pivots 303 fits through openings 225 in power transfer module 224. Openings 225 abut pivots 303 and help locate power transfer module 224. Openings 225 may fit tightly around pivots 303, whereby pivots 303 may by joined to power transfer module 224 prior to installation.

Openings 233 may be formed in lower portion 241 of power transfer module 224 and used to bolt power transfer module 224 to cylinder head 201. Alternatively, or in addition, openings may be formed in upper portion 243 of power transfer module 224 and used to bolt power transfer module 224 to raised portion 245 of cylinder head 201.

Figure 6:
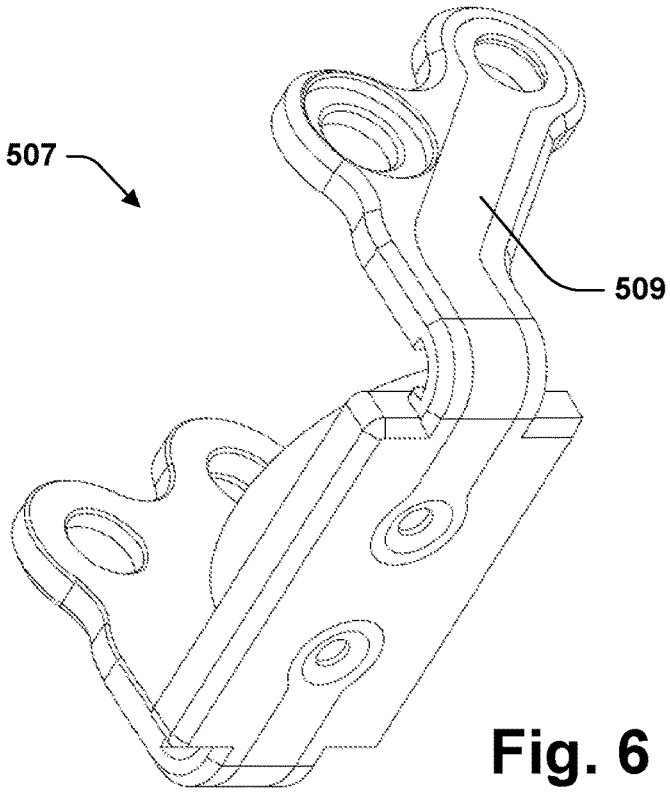
FIG. 6. is a perspective view of a contact frame for the rocker arm assembly of FIG. 3.
Figure 7:
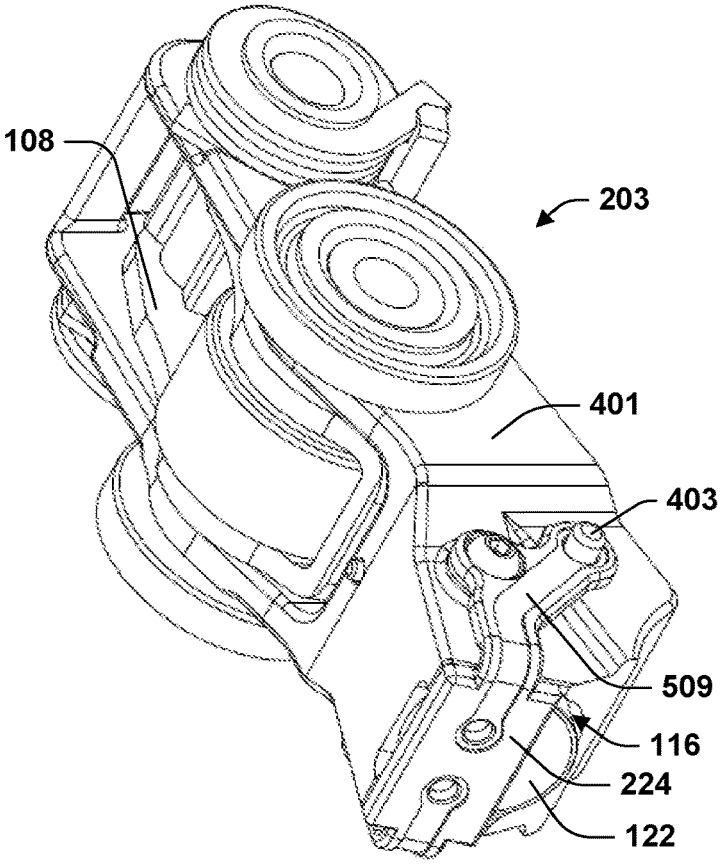
FIG. 7. is a perspective view of the rocker arm assembly of FIG. 3 fit with the contact frame of FIG. 6.

Rocker arm assembly 203 may be less than 25 mm in width and is preferably less than 22 mm in width. As shown in FIG. 7, contact pins 403 may be held to the sides of rocker arm 401 by a contact frame 507. Contact frame 507 is shown separately in FIG. 6. Conductors 509, a type of wiring, couple contact pins 403 to an electrical device inside rocker arm 401. Conductors 509 may be enclosed within contact frame 507. Conductors 509 and/or contact pins 403 may be over-molded within contact frame 507.

Electromagnetic latch assembly 122 may be installed in rocker arm 401 through an opening 116 (see FIG. 7) formed in the back of rocker arm 401. A portion of contact frame 507 may fit in opening 116 when contact frame 507 is mounted on rocker arm 401. Contact frame 507 may be held to rocker arm 401 through contact with opening 116. Alternatively, or in addition, contact frame 507 may mate with the sides of rocker arm 401 to form an interference fit. An interference fit may require contact frame 507 to be deformed outwardly before it can be slid over and allowed to snap into place on rocker arm 401. The interference fit may be formed by inward bulges on contact frame 507 and corresponding indentation on rocker arm 401, or any other suitable combination of protrusions and indentations on these two parts.

Figure 8A:
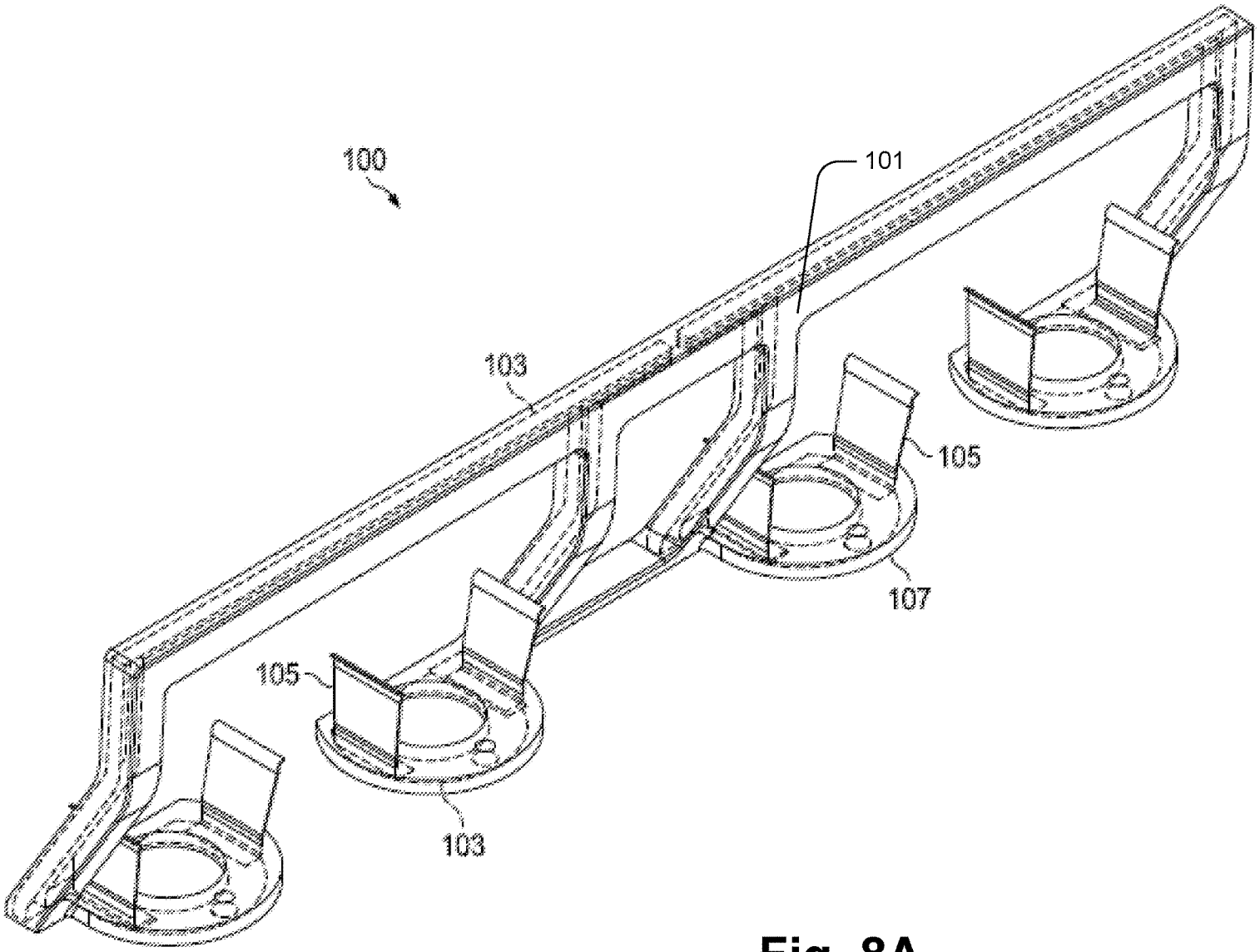
FIG. 8A is a perspective view of a power transfer module according to some aspects of the present teachings.
Figure 8B:
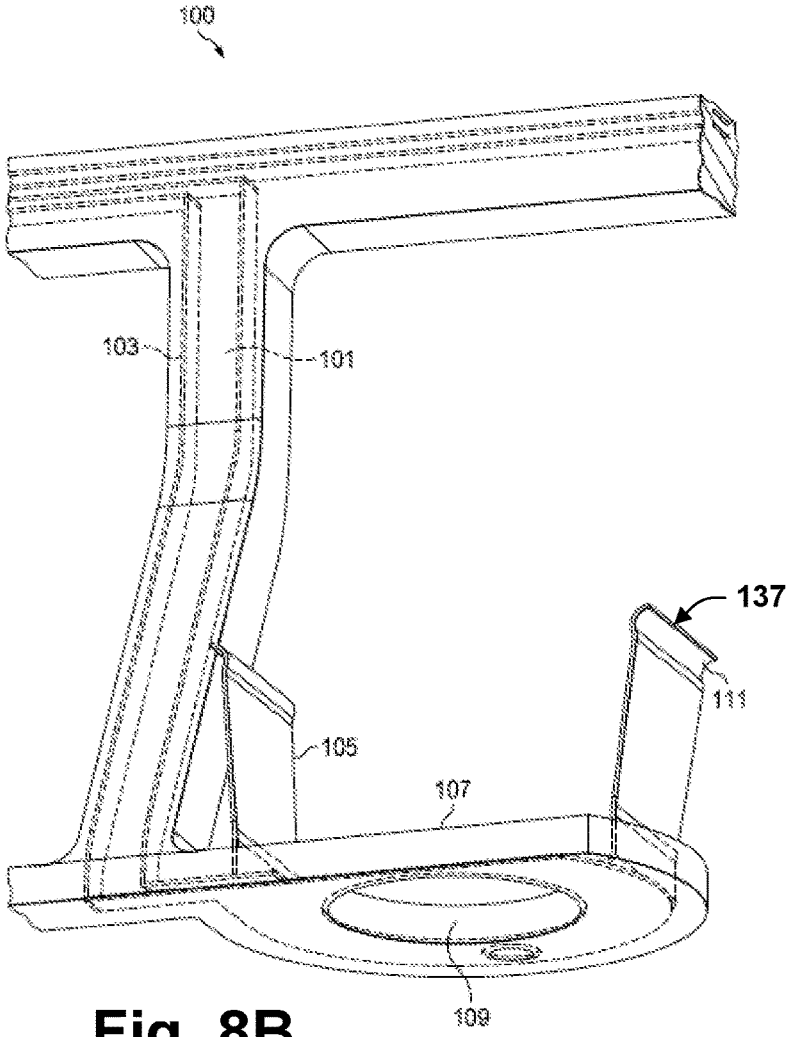
FIG. 8B is a different perspective view showing a portion of the power transfer module of FIG. 8A.
Figure 8C:
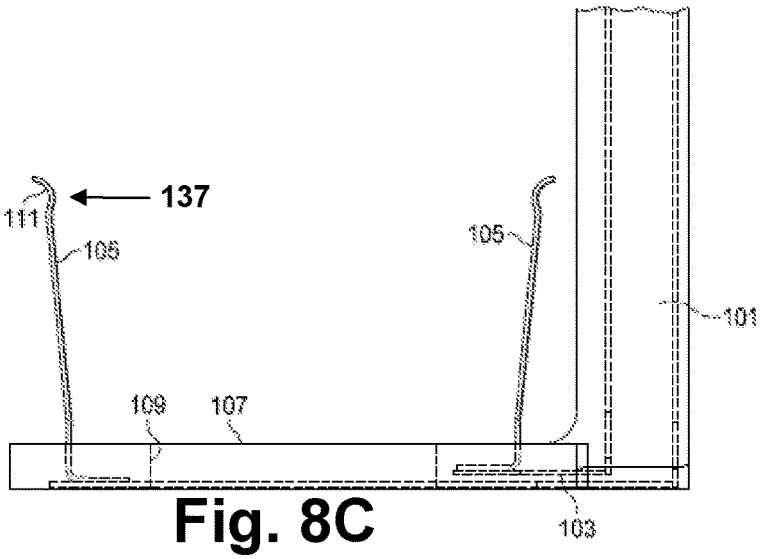
FIG. 8C is a side view of a portion of the power transfer module of FIG. 8A.

FIG. 8A-8C provides various views of a power transfer module 100 according to some other aspects of the present teachings. Power transfer module 100 includes a mounting frame 101, wiring 103 in mounting frame 101, and four pairs of contact pads 105 each extending upward from a base member 107 of mounting frame 101. Contact pads 105 are resilient, formed of sheet metal, and may be described as leaf springs. The middle view is a perspective view that shows the mounting frame 101 including the four base members 107. Wiring 103 is contained in mounting frame 101 making mounting frame 101 a lead frame. Individual wires of wiring 103 couple to contact pads 105. The wires may terminate in a single connection plug (not shown) like the connection plug 135 shown in FIG. 1.

FIG. 8B provides a bottom perspective view of a portion of mounting frame 101 that includes one of the base members 107 and two associated contact pads 105. Circular openings 109 are formed in base members 107 allowing them to fit around pivots. Contact pads 105 are formed from sheet metal and are supported at one end by folds embedded in base 107. Upper ends 137 of contact pads 105 are unsupported and free floating. Contact pads 105 are short, rising 20 mm or less from base 107, in this example a distance in the range from 12-15 mm. Near their upper ends 137, contact pads 105 have inward facing rolls 111 that cause contact pads 105 to bend inward over contact pins 403.

FIG. 8C provides a side view of a portion of power transfer module 100 that includes one of the base members 107 and two associated contact pads 105. As best seen from this view, contact pads 105 generally have an outward taper. This taper is interrupted near the tops of contact pads 105 by inward facing rolls 111, which will protrude toward a rocker arm assembly 203 flanked by contact pads 105. Inward bends in contact pads 105, such as those that are integral with inward facing rolls 111, facilitates retention of the rocker arm assembly 203 on a pivot 303.

Figure 9:
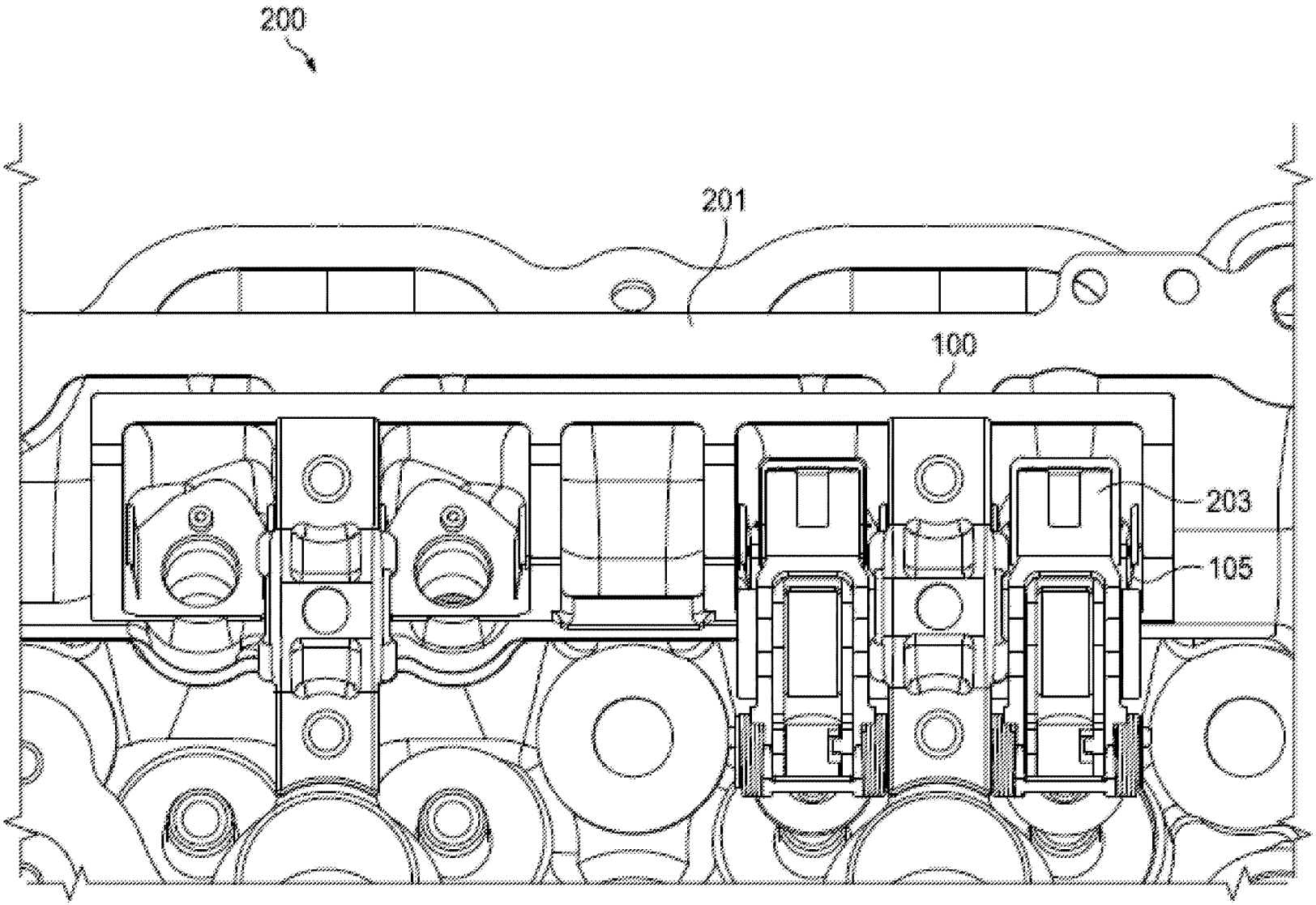
FIG. 9 is a cutaway overhead view of an engine according to some aspects of the present teachings.

FIG. 9 provides a cutaway overhead view of an engine 200 including a cylinder head 201 on which power transfer module 100 has been installed. Installed in this manner, contact pads 105 are located to either side of rocker arm assemblies 203.

Figure 10:
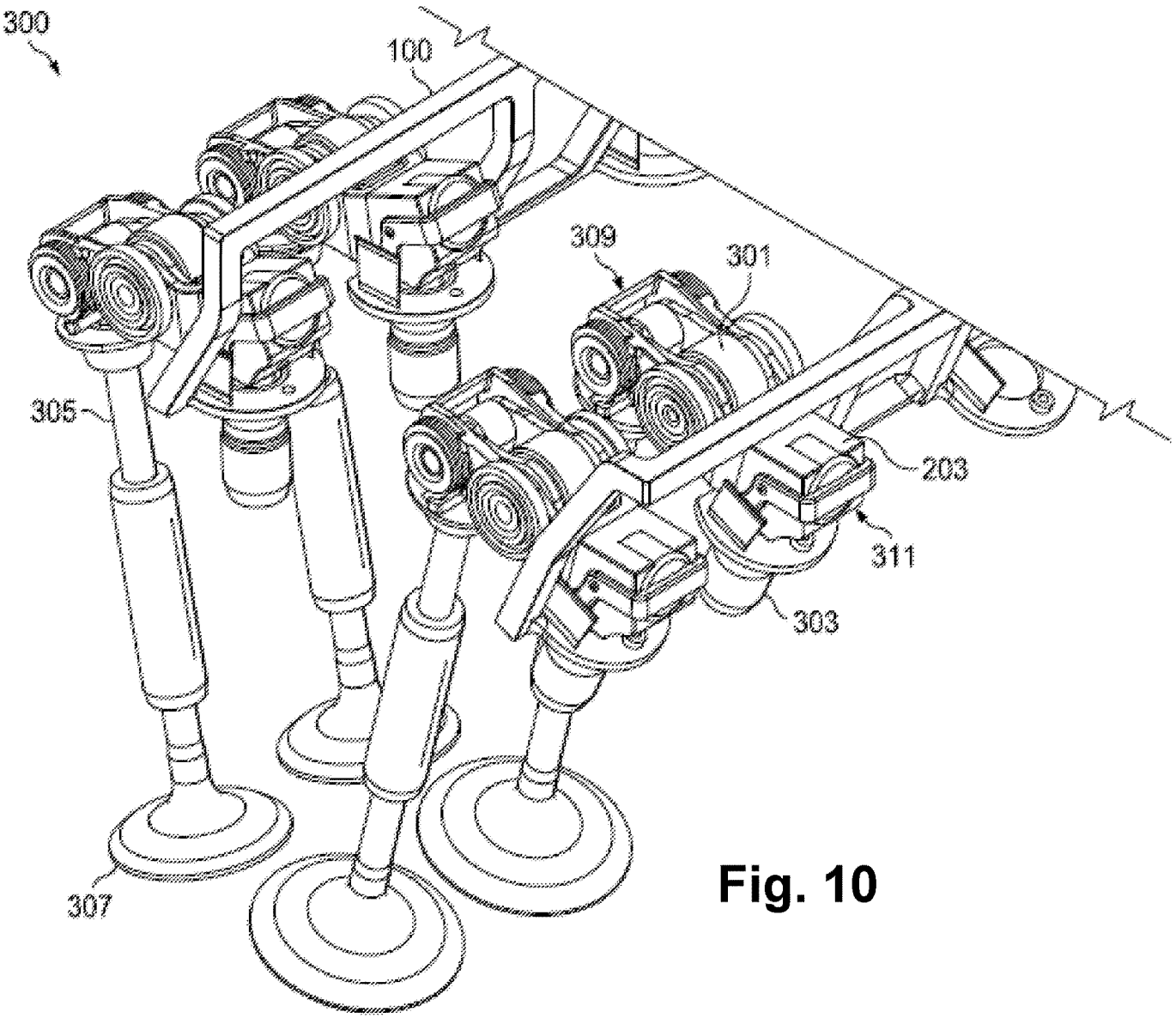
FIG. 10 is a perspective view of a portion of a valvetrain according to some aspects of the present teachings with the power transfer module of FIG. 8A.

FIG. 10 provides a perspective view of a portion of a valvetrain 300 including two power transfer modules 100 and four rocker arm assemblies 203. One of the power transfer modules 100 may be for a set of exhaust valves and the other power transfer modules 100 may be for a set of intake valves. Each rocker arm assembly 203 has a front end 309 proximate where the rocker arm assembly 203 contacts a valve stem 305 of a poppet valve 307 and a back end 311 proximate where the rocker arm assembly 203 rests on a pivot 303. Pivots 303 may be hydraulic lash adjusters that rise from bores in cylinder head 201. Each rocker arm assembly 203 includes a cam follower 301 for engaging a cam on a camshaft of valvetrain 300 (cams and camshafts shown in FIG. 5).

Figure 11:
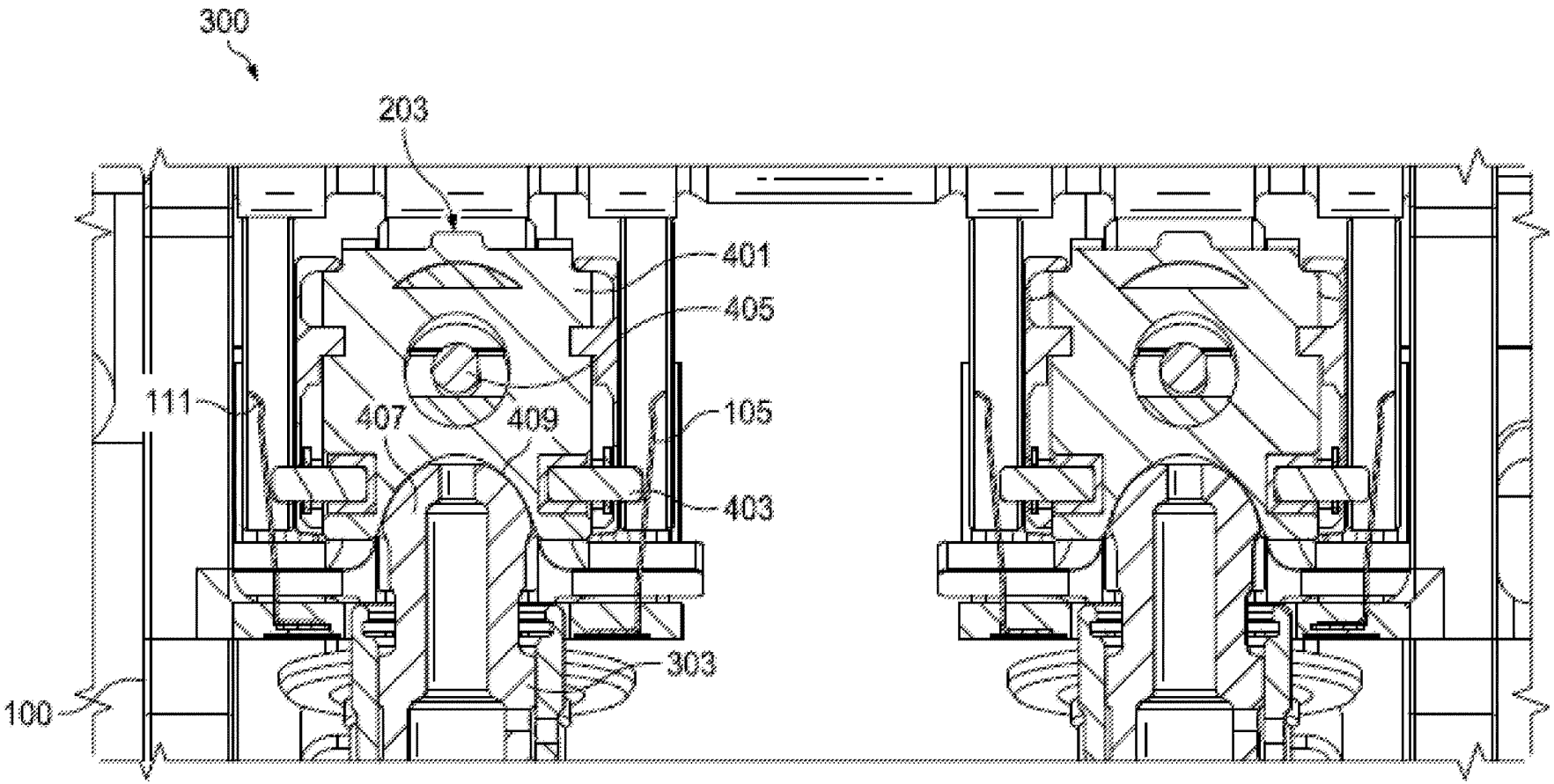
FIG. 11 is a cross-sectional rear view showing a portion of a valvetrain according to some aspects of the present teachings.

FIG. 11 provide a cross-sectional rear view of a portion of valvetrain 300 including a power transfer module 100, two pivots 303, and two rocker arm assemblies 203. A shown by this view, each rocker arm assembly 203 includes a rocker arm 401 having a latch pin 405 and two contact pins 403. Contact pins 403 may be piloted in holes on either side of rocker arm 401. Contact pins 403 may power an electromagnet (not shown) that is operative to actuate latch pin 405 between first and second positions. Placing latch pin 405 in the first position provides a configuration in which rocker arm assembly 203 is operative to actuate poppet valve 307 in response to rotation of the camshaft to produce a first valve lift profile. Placing latch pin 405 in the second position provides a configuration in which rocker arm assembly 203 is operative to actuate poppet valve 307 in response to rotation of the camshaft to produce a second valve lift profile, which is distinct from the first valve lift profile, or poppet valve 307 is deactivated. Latch pin 405 and the electromagnet are part of an electromagnetic latch assembly 122 that effectuates this mode switching.

Rocker arm assemblies 203 may be installed on pivots 303 by pushing them downward until gothics 409 of rocker arms 401 contact domes 407 of pivots 303. This installation process may include deforming contact pads 105 outward to allow contact pins 403 to move past inward facing rolls 111. After installation, contact pads 105 are resiliently biased against contact pins 403. If rocker arm assembly 203 begins to rise off pivot 303, contact pins 403 may encounter inward facing rolls 111, which may then function to retain rocker arm assembly 203 on pivot 303.

Figure 12:
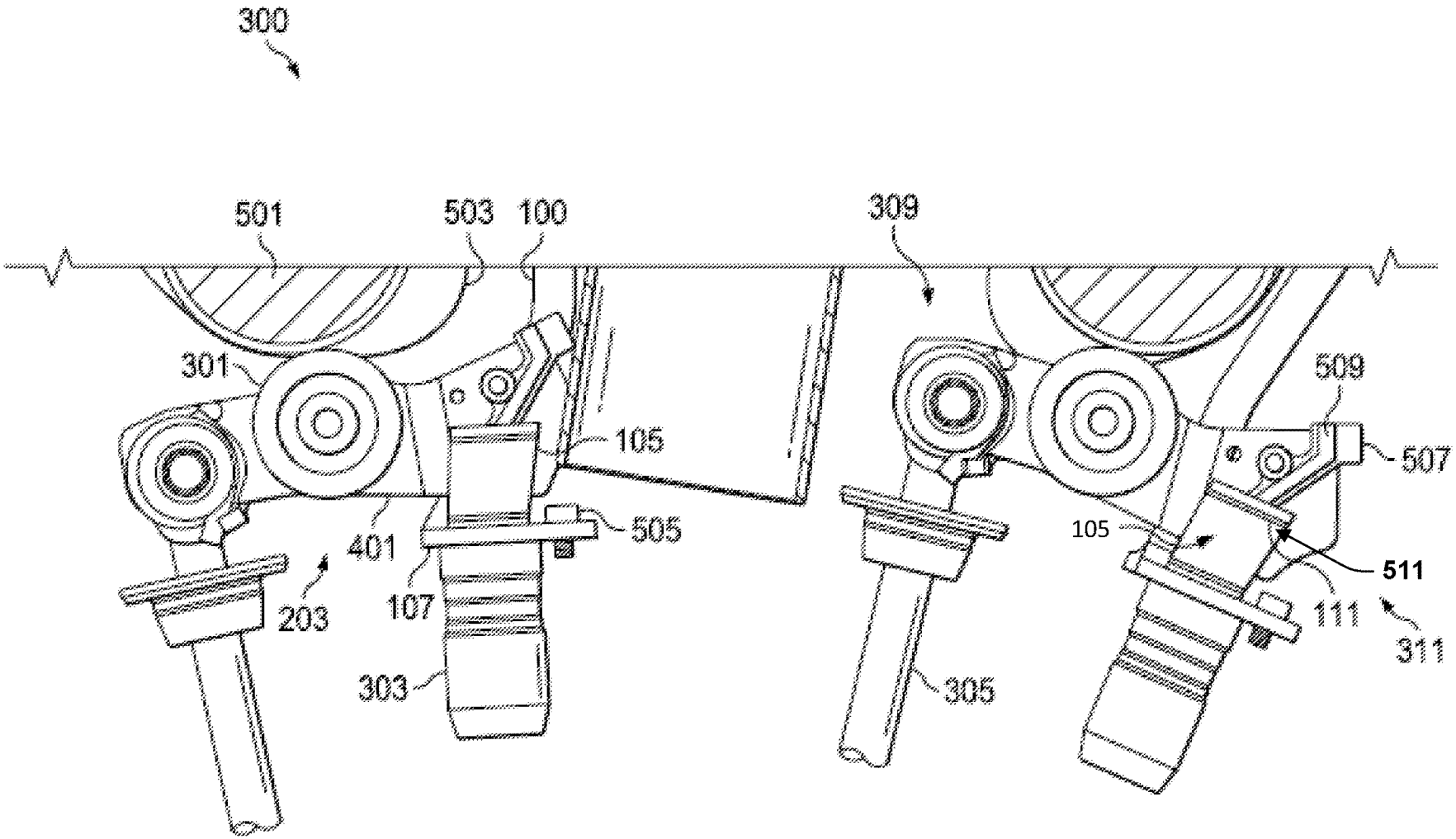
FIG. 12 is a side view of a portion of a valvetrain according to some aspects of the present teachings.

FIG. 12 provides a side view of a portion of valvetrain 300 including camshafts 501 and cams 503. Cams 503 engage cam followers 301 as camshafts 501 rotate. Bases 107 of power transfer module 100 rest on cylinder head 201 and may be attached to cylinder head 201 by bolts 505. Bases 107 abut and fit around pivots 303. Having bases 107 abut and/or go around pivots 303 helps located contact pads 105 relative to contact pins 403. In the present disclosure "go around" means that after bases 107 are slid down onto pivots 303, bases 107 surround pivots 303 to a sufficient extent to restrict motion of bases 107 in any lateral direction.

FIG. 12 shows rocker arms 401 fit with contact frames 507. Contact frames 507 have conductors 509, which are leads that may couple contact pins 403 with poles of an electromagnet housed in rocker arm 401. FIG. 12 also shows that contact pads 105 have a rearward taper. This rearward taper causes contact pads 105 to extend toward back end 311 as they extend upward from base 107 of power transfer module 100. The rearward taper allows inward facing roll 111 to extend into a rearward area 511. During a critical shift, a rocker arm assembly 203 may shift rearward and upward to the point that contact pins 403 encounter inward facing rolls 111 in rearward area 511, at which point inward facing rolls 111 may restrain the rocker arm assembly 203 and allow it to return to its normal position on pivot 303. A critical shift is an event in which latch pin 405 slip out of engagement while rocker arm 401 is on lift, which results in rocker arm 401 moving with abnormal speed.

The components and features of the present disclosure have been shown and/or described in terms of certain embodiments and examples. While a particular component or feature, or a broad or narrow formulation of that component or feature, may have been described in relation to only one embodiment or one example, all components and features in either their broad or narrow formulations may be combined with other components or features to the extent such combinations would be recognized as logical by one of ordinary skill in the art.

The invention claimed is:

1. A valvetrain for an internal combustion engine of a type that has a combustion chamber, a moveable valve having a seat formed in the combustion chamber, and a camshaft, the valvetrain comprising:

a rocker arm assembly comprising a rocker arm and a cam follower configured to engage a cam mounted on the camshaft as the camshaft rotates; and an electrical circuit comprising an electrical device mounted to the rocker arm;

wherein the electrical circuit includes a first electrical connection made by abutment between a first part and a second part, which are two distinct parts;

the valvetrain is operative to slide the second part over the first part in response to actuation of the rocker arm assembly through the cam follower; and the first part is a contact pad having resiliency that biases the contact pad against the second part.

2. The valvetrain of claim 1, wherein the contact pad is held by a mounting frame that rests against a cylinder head of an engine.

3. The valvetrain of claim 1, wherein the contact pad is held by a mounting frame that goes around a pivot that provides a fulcrum for the rocker arm assembly.

4. The valvetrain of claim 3, wherein the mounting frame rests against a cylinder head of an engine.

5. The valvetrain of claim 1, wherein the contact pad is held by a mounting frame that abuts two or more pivots that provide fulcrums for the rocker arm assembly.

6. The valvetrain of claim 1, wherein:

the contact pad is mounted to a part distinct from the rocker arm assembly; and the second part is mounted on the rocker arm.

7. The valvetrain of claim 6, wherein:

the first part is a resilient contact pad; and the second part is a first contact pin.

8. The valvetrain of claim 7, wherein:

the electrical circuit further comprises a second electrical connection made by abutment between a second contact pin and a second resilient contact pad; and the second electrical connection is made on an opposite side of the rocker arm from the first electrical connection.

9. The valvetrain of claim 8, further comprising:

a contact frame that is mounted on the rocker arm and extends from the first contact pin to the second contact pin.

10. The valvetrain of claim 9, wherein:

the electrical circuit further comprises a first conductor that runs from and connects with the first contact pin and a second conductor that connects with the second contact pin; and the first conductor and the second conductor are enclosed within the contact frame.

11. The valvetrain of claim 9, wherein:

the contact frame has a position on the rocker arm and the contact frame must be deformed to be placed in or removed from the position.

12. The valvetrain of claim 8, further comprising:

a pivot that provides a fulcrum for the rocker arm assembly;

wherein the resilient contact pads bend inward toward the rocker arm assembly above the contact pins and the inward bending is operative together with the contact pins to improve retention of the rocker arm assembly on the pivot.

13. The valvetrain of claim 12, wherein the inward bends are integral with inward protrusions of the resilient contact pads.

14. The valvetrain of claim 12, wherein the resilient contact pads are held by a mounting frame that has a base that abuts the pivot.

15. The valvetrain of claim 14, wherein the base goes around the pivot.

16. The valvetrain of claim 14, wherein the mounting frame is over molded about the resilient contact pads.

17. The valvetrain of claim 14, wherein the resilient contact pads extend upward from the base and terminate below a height to which the rocker arm assembly rises above the pivot.

18. The valvetrain of claim 17, wherein the resilient contact pads are free-floating above the base.

19. The valvetrain of claim 17, wherein:

the rocker arm assembly has a front end and a back end;

the rocker arm assembly abuts a valve stem proximate the front end and rests on the pivot proximate the back end; and the resilient contact pads extend toward the back end as they extend upward from the base.

20. The valvetrain of claim 19, wherein the resilient contact pads each comprise a bulge in an area that is above the contact pins and includes an area further toward the back end then the contact pins; and the bulge is functional to facilitate retention of the rocker arm assembly on the pivot during a critical shift.

* * * * *